US008344279B2

(12) United States Patent
Liao

(10) Patent No.: US 8,344,279 B2
(45) Date of Patent: Jan. 1, 2013

(54) MOBILE TERMINAL KEYBOARD

(75) Inventor: Cheng Liao, Beijing (CN)

(73) Assignee: Beijing Borqs Software Technology Co., Ltd., Chaoyang (CN)

( * ) Notice: Subject to any disclaimer, the term of this patent is extended or adjusted under 35 U.S.C. 154(b) by 0 days.

(21) Appl. No.: 13/300,454

(22) Filed: Nov. 18, 2011

(65) Prior Publication Data

US 2012/0111710 A1 May 10, 2012

Related U.S. Application Data

(63) Continuation of application No. PCT/CN2010/077564, filed on Oct. 1, 2010.

(30) Foreign Application Priority Data

Apr. 30, 2010 (CN) ..... 2010 2 0181993

(51) Int. Cl.
*H01H 1/10* (2006.01)

(52) U.S. Cl. ..... 200/512

(58) Field of Classification Search ..... 200/512, 200/5 R, 5 A, 56 R, 61.02, 510–514
See application file for complete search history.

(56) References Cited

U.S. PATENT DOCUMENTS

2006/0139313 A1* 6/2006 Lin et al. ..... 345/156
2010/0321342 A1* 12/2010 Lee ..... 345/175

FOREIGN PATENT DOCUMENTS

CN 2744079 Y 11/2005
CN 1949425 A 4/2007
CN 101499379 A 8/2009

OTHER PUBLICATIONS

International Search Report for PCT/CN2010/077564 mailed on Feb. 24, 2011.
Machine Translation of CN2744079Y obtained from the State Intellectual Property Office of the P.R.C. (SIPO) web site.

* cited by examiner

*Primary Examiner* — Edwin A. Leon
(74) *Attorney, Agent, or Firm* — Knobbe, Martens, Olson & Bear, LLP

(57) ABSTRACT

A mobile terminal keyboard comprises a keyboard body and a key, where sidewalls of the key can produce a cavity so as to form a capsule structure. The keyboard body and the sidewalls can be made of a transparent material; and transparent liquid can be included in the cavity. The mobile terminal keyboard can be convenient for a user and humanized. Light can pass through the transparent liquid in the cavity from one or more directions and generate refraction to form a colorful effect. The liquid in the cavity also can be deformed to generate various color changes on the press of a key.

6 Claims, 1 Drawing Sheet

MOBILE TERMINAL KEYBOARD

CROSS-REFERENCE TO RELATED APPLICATIONS

This application is a continuation of International Patent Application No. PCT/CN2010/077564, filed on Oct. 1, 2010, which claims foreign priority from CN 201020181993.4, filed on Apr. 30, 2010, the disclosures of each of which are incorporated herein by reference in their entirety.

BACKGROUND

1. Field

The present disclosure relates to a mobile terminal, and in certain embodiments relates to a mobile terminal keyboard.

2. Description of the Related Art

Mobile terminals not only can be used to have sessions, take photos, enjoy music, and play games, but also can be used to implement functions such as positioning, information processing, fingerprint scanning, ID card scanning, bar code scanning, RFID scanning, IC card scanning, and alcohol content testing. Therefore, mobile terminals may be useful for mobile law enforcement, mobile office, and mobile business.

Although a keyboard can be implemented on a touch screen display on some mobile terminals, conventional keyboards are still used in many mobile terminal products. The conventional mobile terminal keyboard may not be humanized or aesthetically pleasing. Therefore, a customer's desire for buying mobile terminal products with a conventional keyboard may be reduced.

SUMMARY

To solve or at least reduce the effects of some of the above-mentioned drawbacks, some embodiments of the present disclosure provide a mobile terminal keyboard that can be used by the user more conveniently and in a humanized manner. In addition, in some embodiments, light can penetrate into the cavities of keys of the mobile terminal keyboard from one or more directions and can be refracted by transparent liquid in the cavities. This can create a colorful effect and thereby increase a customer's buying desire.

In an embodiment, the mobile terminal keyboard comprises a keyboard body and a key, where said key further comprises side walls and a cavity enclosed by the side walls. Said key can be in a capsule structure. Said keyboard body and the side walls can form an integral assembly and can be made of a transparent material. The cavity can contain transparent liquid.

In an embodiment, a mobile terminal keyboard can include a keyboard body and a plurality of keys within the keyboard body. Each of the keys can include side walls and a cavity enclosed by the side walls. In some embodiments, the cavity of a first one of the keys can include a liquid that can be configured to refract light to emit a first color when the first one of the keys is not pressed and to refract light to emit a second color when the first one of the keys is pressed.

For purposes of summarizing the disclosure, certain aspects, advantages and novel features of the inventions have been described herein. It is to be understood that not necessarily all such advantages can be achieved in accordance with any particular embodiment of the inventions disclosed herein. Thus, the inventions disclosed herein can be embodied or carried out in a manner that achieves or optimizes one advantage or group of advantages as taught herein without necessarily achieving other advantages as can be taught or suggested herein.

BRIEF DESCRIPTION OF THE DRAWINGS

The accompanying drawings are provided to help further understanding of the present disclosure, and constitute a part of the specification. These drawings are used to describe certain embodiments of the present disclosure, but do not constitute any limitation to the present disclosure. In the drawings.

DETAILED DESCRIPTION

Hereunder various embodiments will be described with reference to the accompanying drawings.

Figure 1:
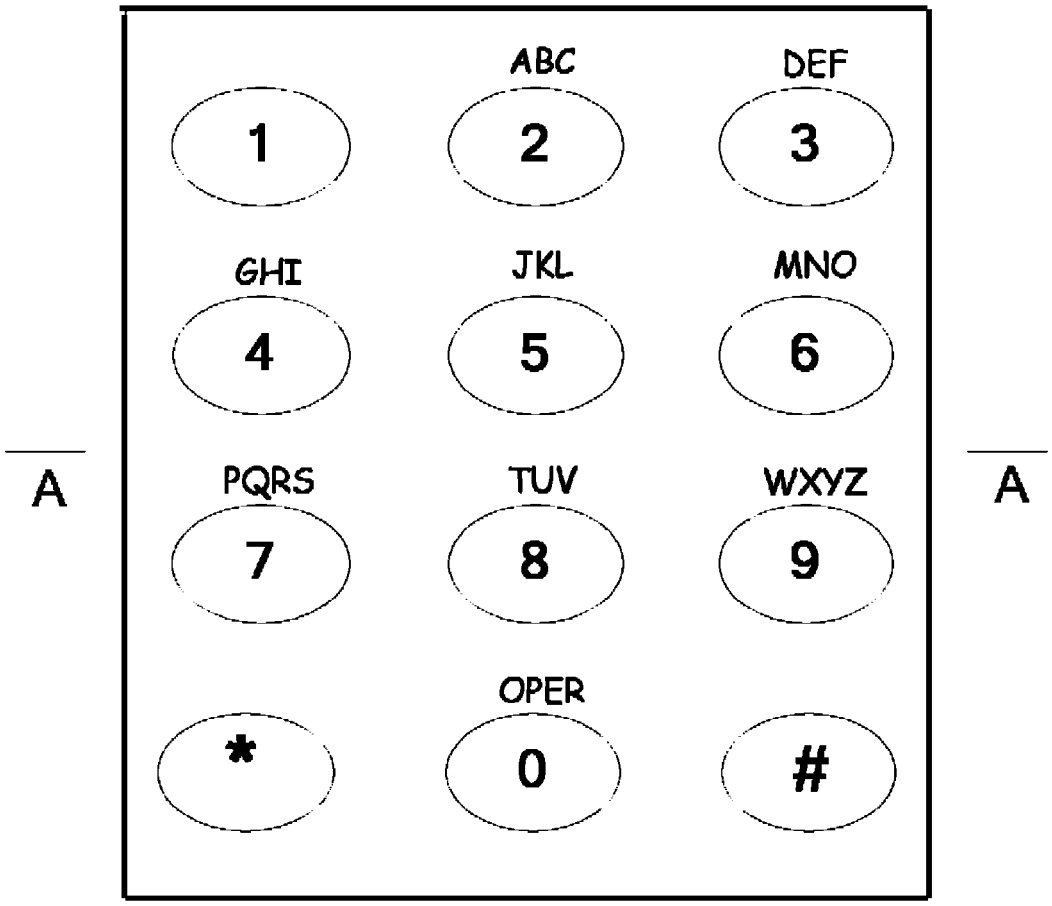
FIG. 1 is a block diagram of an embodiment of a front view of a mobile terminal keyboard.

FIG. 1 is a block diagram of an embodiment of a front view of a mobile terminal keyboard. As shown in FIG. 1, the mobile terminal keyboard can include a keyboard body and a key, where the key can be in a capsule structure, or can be made into various shapes according to a user's preference. For example, the key can be made into a cube, a circular cylinder, an elliptical cylinder shape, or the like.

Figure 2:
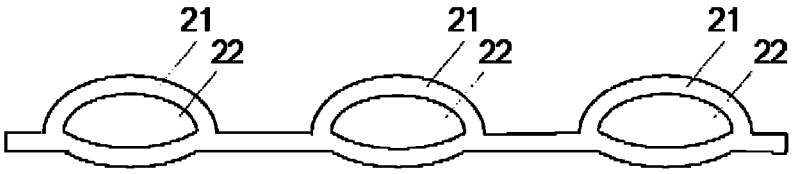
FIG. 2 is a functional diagram of an embodiment of a sectional view A-A of a mobile terminal keyboard.

FIG. 2 is functional diagram of an embodiment of a sectional view A-A of the mobile terminal keyboard. As shown in FIG. 2, the keyboard body and the key can form an integral assembly, where the key can include side walls 21 and a cavity 22 enclosed by the side walls 21. The keyboard body and the side walls can be made of a transparent material, and the enclosed cavity can contain transparent liquid.

In an embodiment, the key can be made of a transparent material and can contain, inside of the cavity, a transparent liquid. Light can penetrate into the key from one or more directions and can be refracted by the transparent liquid. This can create a colorful effect. In addition, the transparent liquid in the cavity of the key can be deformed and thereby change into various colors under the pressure of the press of a key.

Many other variations than those described herein will be apparent from this disclosure. For example, depending on the embodiment, certain acts, events, or functions of any of the algorithms described herein can be performed in a different sequence, can be added, merged, or left out all together (e.g., not all described acts or events are necessary for the practice of the algorithms). Moreover, in certain embodiments, acts or events can be performed concurrently, e.g., through multi-threaded processing, interrupt processing, or multiple processors or processor cores or on other parallel architectures, rather than sequentially. In addition, different tasks or processes can be performed by different machines and/or computing systems that can function together.

The various illustrative logical blocks, modules, and algorithm steps described in connection with the embodiments disclosed herein can be implemented as electronic hardware, computer software, or combinations of both. To clearly illustrate this interchangeability of hardware and software, various illustrative components, blocks, modules, and steps have been described above generally in terms of their functionality. Whether such functionality is implemented as hardware or software depends upon the particular application and design constraints imposed on the overall system. The described functionality can be implemented in varying ways for each particular application, but such implementation decisions should not be interpreted as causing a departure from the scope of the disclosure.

The various illustrative logical blocks and modules described in connection with the embodiments disclosed herein can be implemented or performed by a machine, such as a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor can be a microprocessor, but in the alternative, the processor can be a controller, microcontroller, or state machine, combinations of the same, or the like. A processor can also be implemented as a combination of computing devices, e.g., a combination of a DSP and a microprocessor, a plurality of microprocessors, one or more microprocessors in conjunction with a DSP core, or any other such configuration. Although described herein primarily with respect to digital technology, a processor may also include primarily analog components. For example, any of the signal processing algorithms described herein may be implemented in analog circuitry. A computing environment can include any type of computer system, including, but not limited to, a computer system based on a microprocessor, a mainframe computer, a digital signal processor, a portable computing device, a personal organizer, a device controller, and a computational engine within an appliance, to name a few.

The steps of a method, process, or algorithm described in connection with the embodiments disclosed herein can be embodied directly in hardware, in a software module executed by a processor, or in a combination of the two. A software module can reside in RAM memory, flash memory, ROM memory, EPROM memory, EEPROM memory, registers, hard disk, a removable disk, a CD-ROM, or any other form of non-transitory computer-readable storage medium, media, or physical computer storage known in the art. An exemplary storage medium can be coupled to the processor such that the processor can read information from, and write information to, the storage medium. In the alternative, the storage medium can be integral to the processor. The processor and the storage medium can reside in an ASIC. The ASIC can reside in a user terminal. In the alternative, the processor and the storage medium can reside as discrete components in a user terminal.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

While the above detailed description has shown, described, and pointed out novel features as applied to various embodiments, it will be understood that various omissions, substitutions, and changes in the form and details of the devices or algorithms illustrated can be made without departing from the spirit of the disclosure. As will be recognized, certain embodiments of the inventions described herein can be embodied within a form that does not provide all of the features and benefits set forth herein, as some features can be used or practiced separately from others.

What is claimed is:

1. A mobile terminal keyboard, comprising:

a keyboard body; and a plurality of keys disposed within the keyboard body, wherein each of the keys comprises side walls and a cavity enclosed by the side walls, the cavity of a first one of the keys comprising a liquid that refracts light to emit a first color when the first one of the keys is not pressed and that refracts light to emit a second color when the first one of the keys is pressed.

2. The mobile terminal keyboard of claim 1, wherein each of the keys is enclosed in a capsule structure.

3. The mobile terminal keyboard of claim 1, wherein said keyboard body and each of the side walls form an integral assembly.

4. The mobile terminal keyboard of claim 1, wherein said keyboard body and each of the side walls are made of a transparent material.

5. The mobile terminal keyboard of claim 1, wherein each of the cavities contains transparent liquid.

6. The mobile terminal keyboard of claim 1, wherein each of the keys comprises an elliptical cylinder, a circular cylinder, or a cube shape.

* * * * *